US007751754B2

(12) United States Patent
Nakano

(10) Patent No.: US 7,751,754 B2
(45) Date of Patent: Jul. 6, 2010

(54) IMAGE FORMING APPARATUS PROVIDED WITH AN ELECTROPHOTOGRAPHIC PHOTOSENSITIVE MEMBER

(75) Inventor: Kouichi Nakano, Hakusan (JP)

(73) Assignee: Kyocera Corporation, Kyoto (JP)

( * ) Notice: Subject to any disclaimer, the term of this patent is extended or adjusted under 35 U.S.C. 154(b) by 649 days.

(21) Appl. No.: 11/677,516

(22) Filed: Feb. 21, 2007

(65) Prior Publication Data

US 2007/0201896 A1 Aug. 30, 2007

(30) Foreign Application Priority Data

| | | |
|---|---|---|
| Feb. 24, 2006 | (JP) | 2006-049176 |
| Mar. 28, 2006 | (JP) | 2006-089519 |
| Jun. 26, 2006 | (JP) | 2006-175528 |
| Jan. 31, 2007 | (JP) | 2007-021416 |

(51) Int. Cl.
*G03G 15/00* (2006.01)

(52) U.S. Cl. ..... 399/159; 399/96

(58) Field of Classification Search ..... 399/96, 399/159, 174, 176; 492/16, 17, 27
See application file for complete search history.

(56) References Cited

U.S. PATENT DOCUMENTS

| | | | | |
|---|---|---|---|---|
| 5,019,862 | A * | 5/1991 | Nakamura et al. | 399/44 |
| 5,459,558 | A | 10/1995 | Ishiyama | |
| 6,110,629 | A | 8/2000 | Ehara et al. | |
| 6,122,467 | A | 9/2000 | Ehara et al. | |
| 6,226,479 | B1 | 5/2001 | Karaki et al. | |
| 6,379,852 | B2 | 4/2002 | Tsuchida et al. | |
| 2007/0177897 | A1 * | 8/2007 | Ishii | 399/159 |
| 2007/0201895 | A1 * | 8/2007 | Nakano | 399/96 |

FOREIGN PATENT DOCUMENTS

| | | | |
|---|---|---|---|
| JP | 60182452 | A | 9/1985 |
| JP | 63127267 | A | 5/1988 |
| JP | 04040480 | A | 2/1992 |
| JP | 04076572 | A * | 3/1992 |
| JP | 04230776 | A | 8/1992 |
| JP | 04109776 | A | 9/1992 |
| JP | 05035053 | A | 2/1993 |
| JP | 05297681 | A | 11/1993 |

(Continued)

OTHER PUBLICATIONS

Japanese language office action and its English language translation for corresponding Japanese application 2007021415 lists the references above.

(Continued)

*Primary Examiner*—Robert Beatty
(74) *Attorney, Agent, or Firm*—Hogan Lovells US LLP

(57) ABSTRACT

The present invention relates to an image forming apparatus including an electrophotographic photosensitive member provided with a substantially cylindrical body having outer circumference on which a photosensitive layer with a latent image forming area is formed, and a contact electrification means positioned substantially parallel to the axial direction of the electrophotographic photosensitive member. A nip width of a contact area between the photosensitive layer and the electrification means is larger at a middle portion than at end portions of the latent image forming area. Preferably, the nip width becomes larger gradually or stepwise as proceeding from the end portions to the middle portion of the latent image forming area.

6 Claims, 8 Drawing Sheets

FOREIGN PATENT DOCUMENTS

| | | | | |
|---|---|---|---|---|
| JP | 06202532 | A | * | 7/1994 |
| JP | 08-137115 | | | 5/1996 |
| JP | 08-137115 | A | | 5/1996 |
| JP | 08160809 | A | | 6/1996 |
| JP | 08-179531 | A | | 7/1996 |
| JP | 08-272190 | | | 10/1996 |
| JP | 08-272190 | A | | 10/1996 |
| JP | 11202525 | A | | 7/1999 |
| JP | 11-327183 | A | | 11/1999 |
| JP | 2000065041 | A | * | 3/2000 |
| JP | 2000098642 | A | | 4/2000 |
| JP | 2004-310140 | A | | 11/2004 |
| JP | 2005173283 | A | | 6/2005 |
| JP | 2006039323 | A | | 6/2006 |

OTHER PUBLICATIONS

Japanese language office action and its English language translation for corresponding Japanese application 2007021416 lists the references above.

* cited by examiner

IMAGE FORMING APPARATUS PROVIDED WITH AN ELECTROPHOTOGRAPHIC PHOTOSENSITIVE MEMBER

CROSS-REFERENCE TO RELATED APPLICATIONS

The present application claims priority under 35 U.S.C. §119 to Japanese Patent Application No. 2006-049176, filed Feb. 24, 2006 No. 2006-089519, filed Mar. 28, 2006 No. 2006-175528, filed Jun. 26, 2006, No. 2007-21416, filed Jan. 31, 2007 entitled "ELECTROPHOTOGRAPHIC PHOTOSENSITIVE MEMBER, AND IMAGE FORMING APPARATUS USING SAME." The contents of this application are incorporated herein by reference in their entirety.

TECHNICAL FIELD

The present invention relates to an image forming apparatus provided with an electrophotographic photosensitive member.

BACKGROUND ART

An image forming apparatus such as a copying machine and a printer utilizing electrophotographic method is provided with an electrophotographic photosensitive member. In such image forming apparatus, the electrophotographic photosensitive member is rotated by a power transmitter, and synchronously with the rotation, operations such as electrification, exposure, development, transfer, and cleaning are repeated, thereby forming an image on a recording medium.

Specifically, in the image forming apparatus, the electrophotographic photosensitive member is electrically charged at its surface and then rotated while being irradiated by laser light for exposure, according to an image pattern, so that an electrostatic latent image is formed on the surface of the electrophotographic photosensitive member. Next, the latent image is developed by attaching toner to the photosensitive member. The toner attached to the electrophotographic photosensitive member is transferred to a recording medium. After the transfer of toner to the recording medium, the electrophotographic photosensitive member is rotated while a cleaning blade is pressed onto the surface of electrophotographic photosensitive member, so that remaining toner is removed.

The electrophotographic photosensitive member includes a metal cylindrical body on which a photosensitive layer is formed. The photosensitive layer includes a photoconductive layer formed on the cylindrical body using inorganic material, and a surface layer formed using inorganic material to coat the photoconductive layer. In such electrophotographic photosensitive member, thickness of the photoconductive layer and the surface layer is normally set to be substantially constant in the axial direction of the entire cylindrical body. Here, "substantially constant" means that a ratio ($T_e$:$T_c$) of thickness ($T_c$) at the middle portion of the body to thickness ($T_e$) at one end or the other end of the body is not more than 1.001:1.

DISCLOSURE OF THE INVENTION

An object of the present invention is to provide an image forming apparatus for preventing variation in image density.

According to a first aspect of the present invention, there is provided an image forming apparatus comprising an electrophotographic photosensitive member including a substantially cylindrical body having outer circumference on which a photosensitive layer with a latent image forming area is formed and a contact electrification means positioned substantially parallel to axial direction of the body.

A nip width of a contact area between the photosensitive layer and the electrification means is larger at a middle portion than at end portions of the latent image forming area.

According to a second aspect of the present invention, there is provided an image forming apparatus comprising an electrophotographic photosensitive member including a substantially cylindrical body having outer circumference on which a photosensitive layer with a latent image forming area is formed and a contact electrification means positioned substantially parallel to axial direction of the body.

A nip width at a reference point on the latent image forming area of the electrophotographic photosensitive member is adjusted according to temperature at the reference point.

BEST MODE FOR CARRYING OUT THE INVENTION

An image forming apparatus and an electrophotographic photosensitive member according to the present invention are specifically described below with reference to the accompanying drawings.

Figure 1:
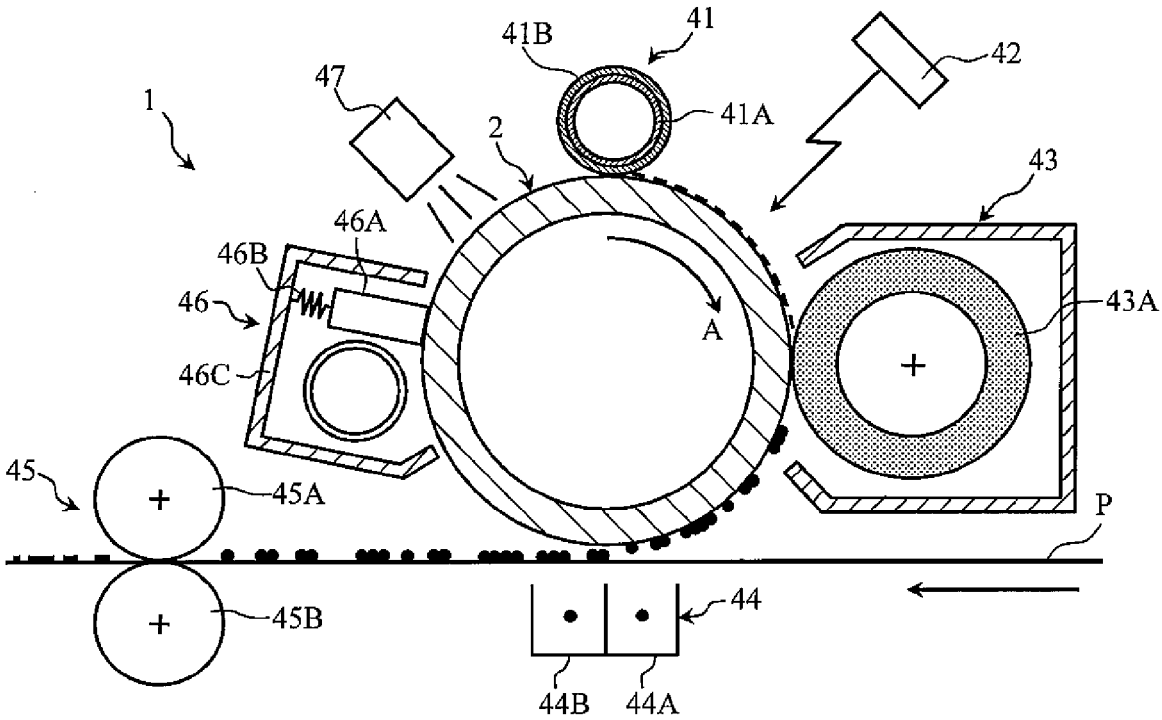
FIG. 1 is a schematic view illustrating an example of an image forming apparatus according to the present invention.
Figure 2:
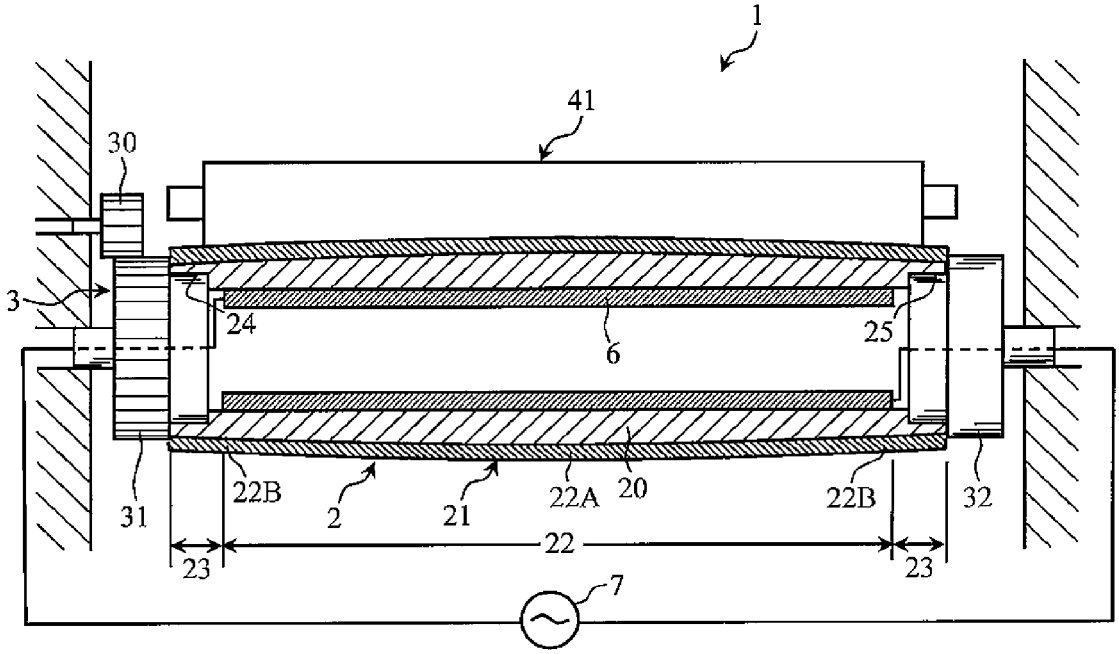
FIG. 2 is a sectional view of the principal portions illustrating the relationship between an electrophotographic photosensitive member and an electrification mechanism of the image forming apparatus shown in FIG. 1.

An image forming apparatus 1 shown in FIGS. 1 and 2 utilizes the Carlson method for image forming, and includes an electrophotographic photosensitive member 2, a rotation mechanism 3, an electrification roller 41, an exposure mechanism 42, a development mechanism 43, a transfer mechanism 44, a fixing mechanism 45, a cleaning mechanism 46, and a discharging mechanism 47.

Figure 3:
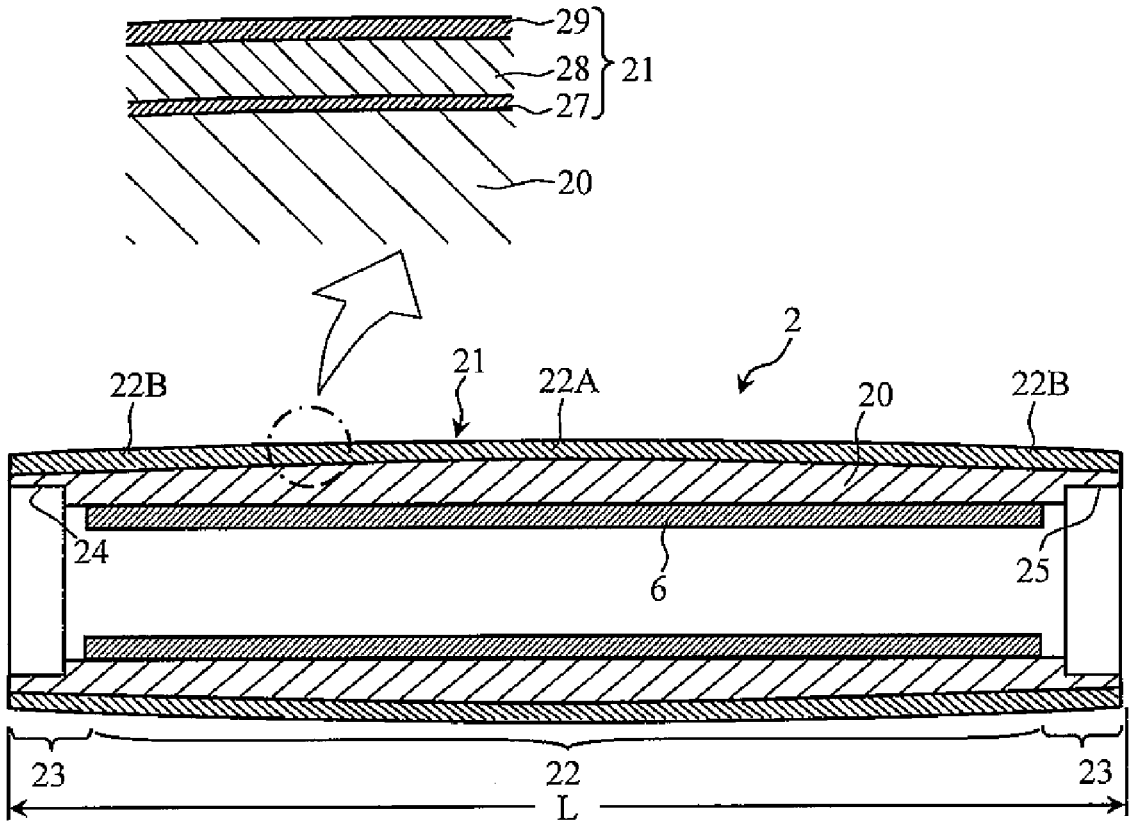
FIG. 3 is a sectional view and an enlarged view of the principal portions illustrating an example of the electrophotographic photosensitive member of the image forming apparatus shown in FIG. 1.

As shown in FIG. 2, an electrophotographic photosensitive member 2 forms an electrostatic latent image or a toner image according to an image signal, and can be rotated in the direction of an arrow A in FIG. 1, by a rotation mechanism 3. As shown in FIG. 3, the electrophotographic photosensitive member 2 includes a cylindrical body 20 having a surface on which a photosensitive layer 21 is formed.

The cylindrical body 20 forms the skeleton of the electrophotographic photosensitive member 2 and holds the electrostatic latent image on its outer circumference. The axis of the cylindrical body 20 has a length L slightly longer than the maximum length of a recording medium P such as a recording paper to be used. Specifically, the length L of the axis is set so that the cylindrical body 20 extends beyond the ends of the recording medium P by not less than 0.5 cm and not more than 5 cm. Thus, the photosensitive layer 21 includes a latent image forming area 22 corresponding to the maximum length of the recording medium P, and non-latent image forming areas 23 provided at the end portions of the cylindrical body, next to the latent image forming area 22. The non-latent image forming areas 23 are areas of the photosensitive layer 21 (at the outside of the latent image forming area 22 in the axial direction) which are never to be used in forming a latent image of any size on the photosensitive layer 21.

In the cylindrical body 20, the outer diameter is larger at a middle portion 22A of the latent image forming area 22 than at end portions 22B of the latent image forming area 22 in the axial direction. In other words, in the cylindrical body 20, the outer diameter gradually becomes larger as proceeding from the end portions 22B toward the middle portion 22A of the latent image forming area 22. In the cylindrical body 20, as shown in FIG. 4A, the outer diameter may gradually become larger at a predetermined inclination as proceeding from the end portions 22B toward the middle portion 22A of the latent image forming area 22, or as shown in FIG. 4B, the outer diameter may become larger stepwise as proceeding from the end portions 22B toward the middle portion 22A of the latent image forming area 22.

Figure 4A:
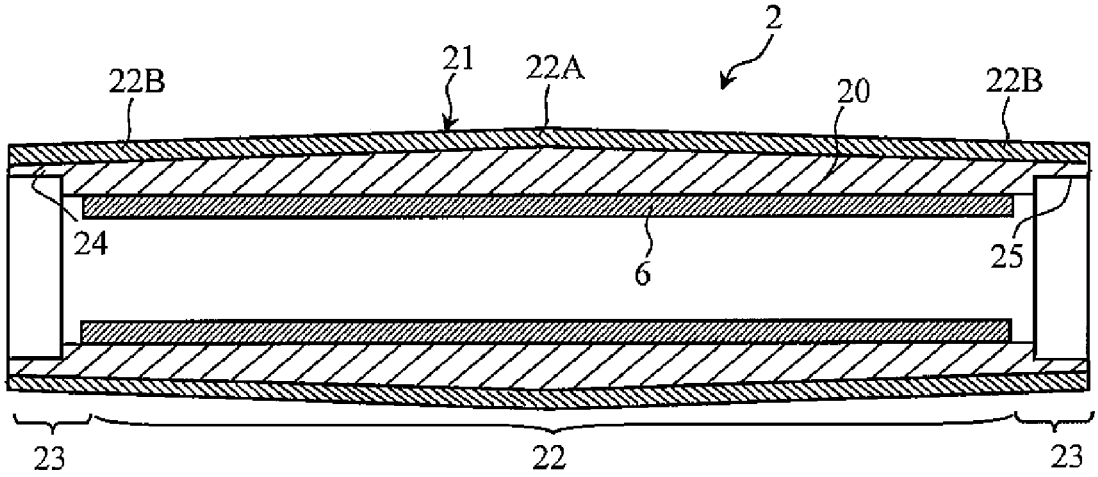
FIGS. 4A and 4B are sectional views illustrating other examples of the electrophotographic photosensitive member of the image forming apparatus shown in FIG. 1.
Figure 4B:
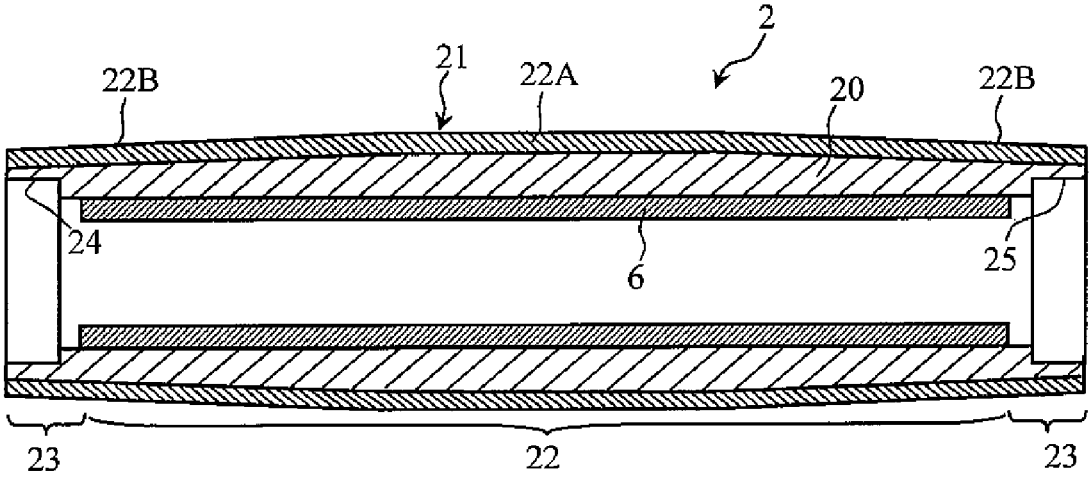

In the cylindrical body 20 shown in FIGS. 3, 4A, 4B, it is preferable that difference between the outer diameters at the end portions 22B of the latent image forming area 22 and at the middle portion 22A of the latent image forming area 22 is not less than 5 μm and not more than 150 μm. By setting the outer diameter of the cylindrical body 20 within the above range, even if a heater 6 to be described later heats the cylindrical body 20 (electrophotographic photosensitive member 2) from its inside when forming images, variation in image density due to variation in temperature of the cylindrical body 20 (electrophotographic photosensitive member 2) in the axial direction can be properly prevented.

Here, the outer diameter of the cylindrical body 20 is a diameter defined by a set of two points on the circumferential outer surface of the cylindrical body 20 opposed to each other. Ten sets of the two points on the circumference of the cylindrical body are measured and the measurement values are averaged to obtain the outer diameter. In measuring the outer diameter, a non-contact laser outer-diameter measuring device may be used, for example.

The cylindrical body 20 is provided with inside low portions 24, 25 having relatively large inner diameter. The inside low portion 24 is a portion to which a power transmitting flange 31, which is to be described later, of the rotation mechanism 3 is fitted (see FIG. 2), while the inside low portion 25 is a portion to which a bearing flange 32, which is to be described later, of the rotation mechanism 3 is fitted (see FIG. 2). The illustrated inside low portions 24, 25 are arranged within areas corresponding to the non-latent image forming areas 23, though may extend to an area corresponding to the latent image forming area 22. Further, the inside low portions 24, 25 may be omitted if not preventing the attachment of the flanges 31, 32.

Such cylindrical body 20 is conductive at least on its surface. Specifically, the cylindrical body 20 may be made of a conductive material as a whole, or may be made of an insulating material having a conductive film formed thereon. The conductive material for forming the cylindrical body 20 may include metal such as Al or SUS (stainless), Zn, Cu, Fer Ti, Ni, Cr, Ta, Sn, Au, and Ag, and an alloy of these metals, for example. The insulating material for forming the cylindrical body 20 may include resin, glass, and ceramic. The material for forming the conductive film may include a transparent conductive material such as ITO (Indium Tin Oxide) and $SnO_2$, other than the above-described metals. The transparent conductive material can be deposited on the surface of the insulating cylindrical body, utilizing a conventional method such as vapor deposition.

Preferably, the cylindrical body 20 is made of a metal such as aluminum alloy or copper alloy. As aluminum alloy, Al—Mn (3000) alloy, Al—Mg (5000) alloy, and Al—Mg—Si (6000) alloy are more preferable. When making the cylindrical body 20 of aluminum alloy, casting, homogenization treatment, hot extrusion, and cold drawing are performed, and if necessary, softening is performed to form an aluminum alloy pipe. The aluminum pipe is cut into a predetermined length and the outer circumferential surface, the end surfaces, and the inside low surface are cut by e.g. working machine.

Further, an ultra-precise lathe with a diamond cutting tool is used for finishing, so that the cylindrical body 20 has a predetermined surface roughness and a predetermined outer diameter. Here, the cylindrical body 20 may be formed to have an outer diameter which is larger at the middle portion 22A of the latent image forming area 22 than at the end portions 22B of the latent image forming area 22 in the axial direction. The form of the outer circumferential surface of the cylindrical body 20 may be easily obtained, when cutting the outer circumference in the body manufacturing process, by using a NC lathe for controlling the movement of the cutting tool by a NC program. Further, grinding may be performed by a grinding machine.

Thereafter, the cylindrical body 20 is cleaned for degreasing cutting oil used in cutting (grinding) and for removing dirt such as swarf. As a cleaning liquid for cleaning, water-based detergent, petroleum detergent, alcohol detergent, or chlorine solvent may be used. Preferably, a cleaning machine having at least two cleaning tubs and one rinsing tub or raising tub is used, and ultrasonic waves are applied to cleaning liquid in the cleaning tubs. In place of applying ultrasonic waves, showering or bubbling by inert gas may be performed. It is preferable that, in the cleaning machine, a cleaning liquid is supplied to one of the cleaning tubs close to a drain outlet with a high cleaning property and overflows to the other cleaning tub close to an inlet.

The cylindrical body 20 accommodates a heater 6 for heating the photosensitive layer 21. The heater 6 prevents image deletion by reducing moisture at the photosensitive layer 21.

Figure 5:
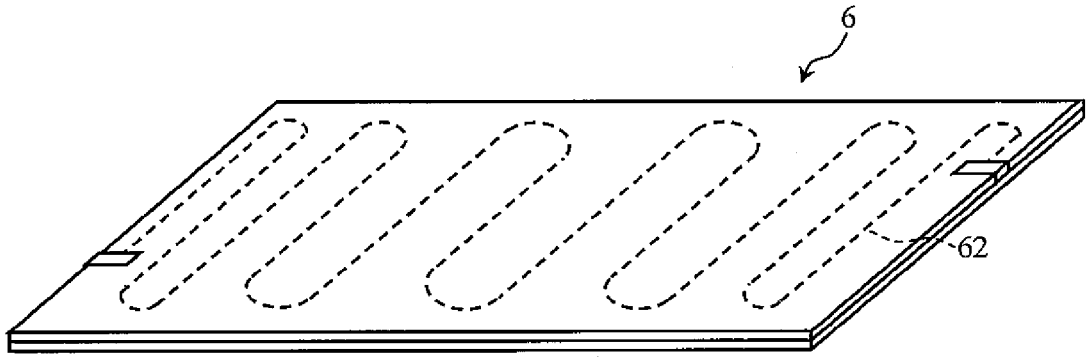
FIG. 5 is an overall perspective view illustrating a heater provided at the electrophotographic photosensitive member shown in FIG. 3 or 4.
Figure 6:
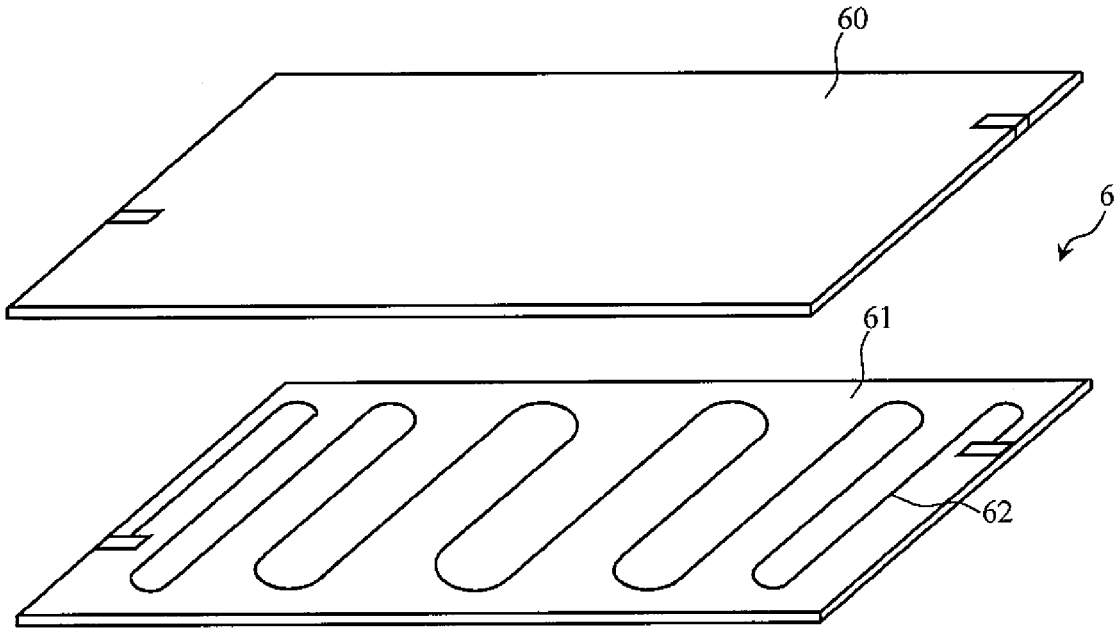
FIG. 6 is an exploded perspective view illustrating the heater of FIG. 5.

As shown in FIGS. 5 and 6, the heater 6 is formed into a sheet as a whole, and is rolled into a tube to be accommodated within the cylindrical body 20. The heater 6 includes a pair of insulating sheets 60, 61 sandwiching a resistor 62 therebetween.

The insulating sheets 60, 61 are made of an insulating resin such as silicon resin, PET (polyethylene terephthalate) and acrylate resin, and has a thickness not less than 0.5 mm and not more than 3.5 mm.

The resistor 62 is formed on the insulating sheets 61 by patterning. In the illustrated example, the resistor 62 is formed in a wavy line in an arrangement thinner at the middle portion than at the end portions. Thus, in the resistor 62 (the heater 6), heat-generating temperature at the middle portion is lower than at the end portions.

A material for making the resistor 62 is not limited at least it generates heat by electrical conduction, and includes a metal such as nickel chrome alloy and copper, and a heat-generating material such as carbon system or metal oxide system, for example. The resistor 62 maybe formed by arranging a wire rod or by coating a film on the insulating sheet 61 using the above-described materials.

Such heater 6 is accommodated within the cylindrical body 20 in contact with the inner circumferential surface utilizing resilience of the insulating sheets 60, 61. Thus, the heater 6 can be accommodated within the cylindrical body 20, without using a screw or an adhesive.

Of course, the structure of the heater 6 is not limited to the one shown in FIGS. 5 and 6. For example, in the heater 6, the resistor 62 is not necessarily formed in an arrangement thinner at the middle portion but may be formed in a uniform arrangement. Further, the resistor 62 is not necessarily formed in a wavy line or into a sheet, but may be formed into a column or other forms.

As shown in FIG. 2, the heater 6 is connected to a power source 7 of the image forming apparatus 1, so that the resistor 62 generates heat by electrical force supplied from the power source 7 and that the photosensitive layer 21 of the electrophotographic photosensitive layer 2 is heated up to not less than 30° C. and not more than 60° C. In this way, moisture at the photosensitive layer 21 is reduced, and thus image deletion is prevented.

As shown in FIG. 3, the photosensitive layer 21 is formed by lamination of an anti-charge injection layer 27, the photoconductive layer 28 and the surface layer 29.

The anti-charge injection layer 27 serves to prevent injection of electrons and electron holes from the cylindrical body 20 into the photoconductive layer 28, and various types of anti-charge injection layer 27 may be used depending on the material of the photoconductive layer 28. The anti-charge injection layer 27 may be made of an inorganic material, for example, and if using a-Si material for the photoconductive layer 28, the anti-charge injection layer 27 may also be made of an inorganic material such as a-Si material. In this way, electrophotographic photosensitive property with enhanced adhesiveness between the cylindrical body 20 and the photoconductive layer 28 can be obtained.

In forming the anti-charge injection layer 27 using a-Si material, the material may contain a thirteenth group element of the periodic system (hereinafter referred to as "thirteenth group element") or a fifteenth group element of the periodic system (hereinafter referred to as "fifteenth group element") in an amount larger than those contained in the photoconductive layer 28 of a-Si material so as to determine the conductivity type. Further, a large amount of boron (B), nitrogen (N), or oxygen (O) may be also contained so as to have high resistivity.

Note that the anti-charge injection layer 27 is optional and is not always necessary. The anti-charge injection layer 27 maybe replaced with a long-wavelength light absorbing layer. The long-wavelength light absorbing layer prevents a long-wavelength light (light of a wavelength of not less than 0.8 μm) entering on exposure from reflecting on the surface of the cylindrical body 20, and thus prevents a fringe pattern generated at a formed image.

In the photoconductive layer 28, electrons are excited by a laser irradiation from the exposure mechanism 42, and a carrier of free electrons or electron holes is generated. The thickness of the photoconductive layer 28 maybe determined according to a photoconductive material and a desired electrophotographic property.

The photoconductive layer 28 is formed of a-Si material, amorphous selenium material such as a-Se, Se—Te, and As2Se3, or chemical compound of twelfth group element and sixteenth group element of the periodic system such as ZnO, CdS, and CdSe, for example. As the a-Si material, a-Si, a-SiC, a-SiN, a-SiO, a-SiGe, a-SiCN, a-SiNO, a-SiCO or a-SiCNO may be used. Especially when the photoconductive layer 28 is made of a-Si, or an a-Si alloy material of a-Si and an element such as C, N, and O, it is able to have high luminous sensitivity, high-speed responsiveness, stable repeatability, high heat resistance, high endurance, and so on, thereby reliably obtaining enhanced electrophotographic property. Further, in addition to the above condition, by forming the surface layer 29 using a-SiC:H, conformity of the photoconductive layer with the surface layer 29 is enhanced. The photoconductive layer 28 may be also formed by changing the above-described inorganic material into particles, and by dispersing the particles in a resin, or may be formed as an OPC photoconductive layer.

In forming the photoconductive layer 28 using an inorganic material as a whole, it can be formed by conventional film formation methods such as glow discharge decomposition method, various sputtering methods, various vapor deposition methods, ECR method, photo-induced CVD method, catalyst CVD method, and reactive vapor deposition method, for example. In film forming of the photoconductive layer 28, hydrogen (H) or a halogen element (F, Cl) may be contained in the film by not less than one atom % and not more than 40 atom % for dangling-bond termination. Further, in forming the photoconductive layer 28, for obtaining a desired property such as electrical property including e.g. dark conductivity and photoconductivity as well as optical bandgap in respective layers, thirteenth group element or fifteenth group element, or an adjusted amount of element such as C, N, and O may be contained.

As the thirteenth group element and the fifteenth group element, in view of high covalence and sensitive change of semiconductor property, as well as of high luminous sensitivity, it is desired to use boron (B) and phosphorus (P). When the thirteenth group element and the fifteenth group element are contained in combination with elements such as C, N, and O, preferably, the thirteenth group element may be contained by not less than 0.1 ppm and not more than 20000 ppm, while the fifteenth group element may be contained by not less than 0.1 ppm and not more than 10000 ppm.

When the photoconductive layer 28 contains none or only a small amount (not less than 0.01 ppm and not more than 100 ppm) of the elements such as C, N, and O, preferably, the thirteenth group element may be contained by not less than 0.1 ppm and not more than 200 ppm, while the fifteenth group element may be contained by not less than 0.01 ppm and not more than 100 ppm. These elements may be contained in a manner that concentration gradient is generated in the thickness direction of the layers, if the average content of the elements in the layers is within the above-described range.

In forming the photoconductive layer 28 using a-Si material, μc-Si (microcrystal silicon) maybe contained, which enhances dark conductivity and photoconductivity, and thus advantageously increases design freedom of the photoconductive layer 3. Such μc-Si can be formed by utilizing a method similar to the above-described method, and by changing the film forming condition. For example, when utilizing glow discharge decomposition method, the layer can be formed by setting temperature and high-frequency electricity at the cylindrical body 20 higher than in the case using only a-Si, and by increasing flow amount of hydrogen as diluent gas. Further, impurity elements similar to the above-described elements may be added when μc-Si is contained.

The surface layer 29 shown in FIG. 3 for protecting the photoconductive layer 28 from friction and wear is laminated on the surface of the photoconductive layer 28. The surface layer 29 is formed of an inorganic material represented by a-Si material such as a-SiC, and has a thickness of not less than 0.2 μm and not more than 1.5 μm. By making the surface layer 29 to have a thickness of not less than 0.2 μm, flaw in image and variation in density due to wear can be adequately prevented, and by making the surface layer 26 to have a thickness of not more than 1.5 μm, initial characterization (such as defective image due to residual potential) can be adequately improved. Preferably, the thickness of the surface layer 29 may be not less than 0.5 μm and not more than 1.0 μm.

Such surface layer 29 is preferably formed of a-SiC:H in which a-SiC contains hydrogen. Proportion of elements in a-SiC:H can be expressed in a composition formula a-$Si_{1-x}C_X$:H, in which the value of X is not less than 0.55 and less than 0.93, for example. By setting the value X to not less than 0.55, a proper hardness for the surface layer 29 can be obtained, and endurance of the surface layer 29 and thus of the electrophotographic photosensitive member 2 can be reliably maintained. By setting the value X to less than 0.93, a proper hardness for the surface layer 29 can be also obtained. Preferably, the value X is set to not less than 0.6 and not more than 0.7. In forming the surface layer 29 using a-SiC:H, H content may be set to about not less than one atom % and not more than 70 atom %. When the H content is set within the above range, Si—H binding is lower than Si—C binding, electrical charge trap generated by light irradiation on the surface of the surface layer 26 can be controlled, thereby suitably preventing residual potential. According to the knowledge of the inventors, by setting the H content to not more than about 45 atom %, more favorable result can be obtained.

Figure 7:
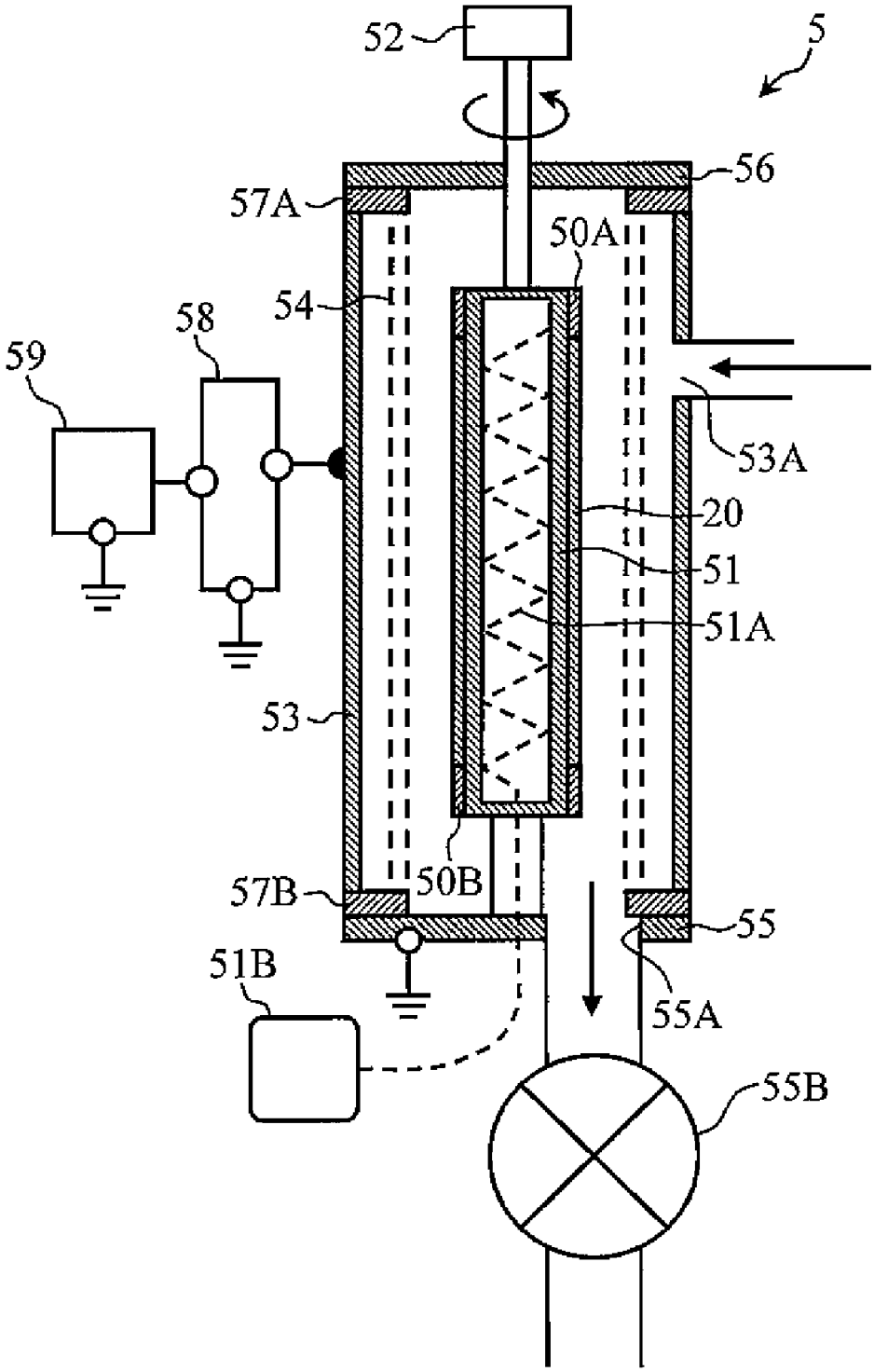
FIG. 7 is a sectional view illustrating a CVD apparatus for forming a photosensitive layer of the electrophotographic photosensitive member shown in FIG. 3 or 4.

Such photosensitive layer 21 (including the anti-charge injection layer 27, the photoconductive layer 28, and the surface layer 29) can be formed utilizing a CVD apparatus 5 shown in FIG. 7. The illustrated CVD apparatus 5 includes a body holder 51 to which the cylindrical body 20 is attached. The body holder 51 incorporates a heater 51A. The heater 51A is provided with a temperature controller 51B for controlling heating temperature. The body holder 51 is rotated by a motor 52.

The CVD apparatus 5 also includes various components, such as a chamber 53, a discharging electrode plate 54, a reactor base 55, a reactor lid 56, and insulating rings 57A, 57B, surrounding the body holder 51 (the cylindrical body 20) for providing a reactor. The chamber 53 is provided with a gas inlet port 53A for introducing reaction gas, while the reactor base 55 is provided with an exhaust port 55A and a discharge valve 55B connected thereto, for pressure control in the CVD apparatus 5. The CVD apparatus 5 further includes a high-frequency power source 58 for performing electrical discharge between the cylindrical body 20 and the discharging electrode plate 54. The high-frequency power source 58 is connected to a matching box 59 for stabilizing glow discharge.

When forming the photosensitive layer 21 on the cylindrical body 20 using the CVD apparatus 5, first, the cylindrical body 20 after cleaning is inserted into the body holder 51 together with positioning rings 50A, 50B, so that the cylindrical body 20 is positioned within the reactor. Meanwhile, air in the reactor is discharged through the exhaust port 55A to depressurize the reactor.

Next, the cylindrical body 20 and the body holder 51 are rotated by the motor 52, while temperature of the cylindrical body 20 is heated up by the heater 51A and the temperature controller 51B. The heating of the cylindrical body 20 and the depressurizing of the reactor may be performed at the same time, or may be performed in reverse order.

Thereafter, by adjusting the amount of supply gas flowing in through the gas inlet port 53A and exhaust gas flowing out through the exhaust port 55A to control pressure in the reactor.

The supply gas is a mixture of material gas and diluent gas. As the material gas, e.g. $SiH_4$, $B_2H_6$, or NO may be used when forming the anti-charge injection layer 27, e.g. $SiH_4$ or $B_2H_6$ may be used when forming the photoconductive layer 28, and e.g. $SiH_4$ or $CH_4$ may be used when forming the surface layer 29. Gas of the same quality and system as the above-described gases may be used as the material gas. For example, $Si_2H_6$, $B_4H_{10}$, $N_2O$, and acetylene gas or butane may be used in place of $SiH_4$, $B_2H_6$, NO, and $CH_4$, respectively. As the diluent gas, hydrogen gas, helium gas, or argon gas may be used, for example.

Meanwhile, high frequency power is applied to the chamber 53 and the discharging electrode plate 54 by the high frequency power source 58 via the matching box 59, so that glow discharge is performed between the cylindrical body 20 and the discharging electrode plate 54. In this way, the mixed material gas is decomposed and deposited on the cylindrical body 20, thereby forming the anti-charge injection layer 27, the photoconductive layer 28, and the surface layer 29. Here, as the cylindrical body 20 is rotated by the motor 52, film thickness and photoconductive characteristic of the photosensitive layer 21 (including the anti-charge injection layer 27, the photoconductive layer 28, and the surface layer 29) are made to be constant in the circumferential direction.

As shown in FIG. 2, the rotation mechanism 3 rotates the electrophotographic photosensitive member 2. The rotation mechanism 3 rotates the electrophotographic photosensitive member 2 at a constant circumferential velocity of 320 mm/sec. The rotation mechanism 3 includes a drive gear 30, the power transmitting flange 31, and the bearing flange 32.

The drive gear 30 transmits the rotation power of a motor (not shown) to the power transmitting flange 31.

The power transmitting flange 31 transmits the rotation power from the drive gear 30 to the electrophotographic photosensitive member 2. The power transmitting flange 31 is fitted into the inside low portion 24 of the cylindrical body 20.

The bearing flange 32 rotatably supports the electrophotographic photosensitive member 2. The bearing flange 32 is fitted into the inside low portion 25 of the cylindrical body 20.

As shown in FIGS. 1 and 2, the electrification roller 41 is of contact type and is positioned substantially parallel to the axial direction of the electrophotographic photosensitive member 2, while pressing the surface of the electrophotographic photosensitive member 2 at a pressure force of not less than 5N and not more than 50N. The electrification roller 41 serves to charge the photosensitive layer by applying a direct-current voltage or a vibration voltage of superimposed direct-current voltage and alternating-current voltage, and includes a conductive member 41A and a resistor layer 41B.

The conductive member 41A is made of iron, stainless, steel, or aluminum alloy, and formed into a hollow or solid cylinder.

The resistor layer 41B covering the conductive member 41A is made to have a volume resistivity value of not less than $10^5$ Ω·cm and not more than $10^{12}$ Ω·cm. Such a resistor layer 41B is made into a resin roller by performing injection molding method, using a mixture of a resin material and a conductive material, for example. The resin material may include EEA resin (ethylene ethyl acrylate), POM resin (polyacetal), PA resin (nylon, polyamid), PBT resin (polybutylene terephthalate), and PPS resin (polyphenylene sulfide), for example. The conductive material may include a magnetic body of ferrite system, alnico system, or neodymium system. The resistor layer 41B' may also be made of urethane rubber or silicon rubber, by adding a conducting particle such as carbon black, if necessary, adding sulfating agent or foaming agent, and performing heat foaming. As described above, the electrification roller 41 contacts the surface of the electrophotographic photosensitive member 2 to charge the electrophotographic photosensitive member 2. Thus, when the hardness of the resistor layer 41B is not enough, form of the roller is not stabilized due to the pressure force in contact, whereas when the hardness is too high, a proper nip width can not be obtained. Thus, when forming the resistor layer 41B by a rubber material, spring hardness (Asker C hardness) of the resistor layer 41B is preferably set within a range of not less than 20 degree and not more than 70 degree.

Figure 8:
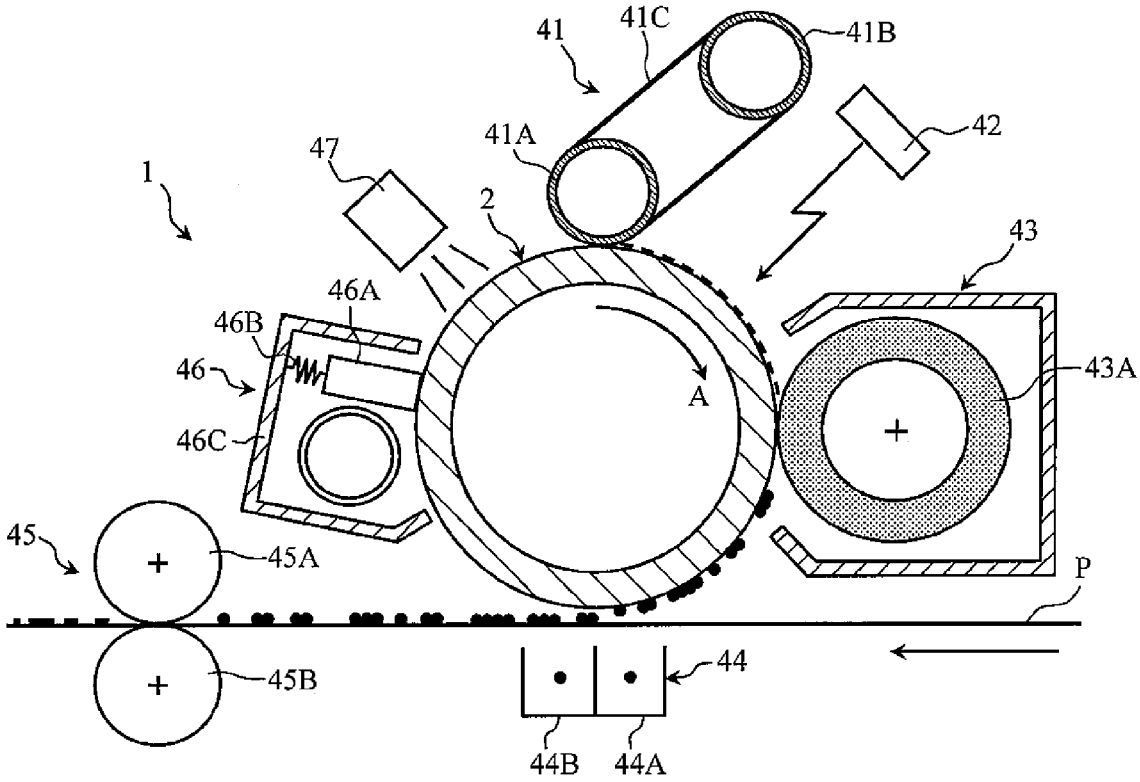
FIG. 8 is a schematic view corresponding to FIG. 1, illustrating another example of the image forming apparatus according to the present invention.

As the electrification mechanism, a contact electrification belt 41' shown in FIG. 8 may be used. The electrification belt 41' includes a pair of rollers 41A', 41B', and an endless belt 41C' bridging therebetween.

The paired rollers 41A', 41B', or at least the roller 41A' is provided with a conductive member. The conductive member may be the same as the conductive member 41A (see FIG. 1) of the electrification roller 41 described above.

The endless belt 41C' is made to have a volume resistivity value of not less than $10^5$ Ω·cm and not more than $10^{12}$ Ω·cm. Such endless belt 41C' may be formed of a material the same as the resistor layer 41B of the electrification roller 41 (see FIG. 1).

In the contact electrification roller 41 shown in FIGS. 1 and 2 and the contact electrification belt 41' shown in FIG. 8, larger nip width relative to the photosensitive layer 21 provides higher electrification potential at the photosensitive layer 21, whereas smaller nip width provides lower electrification potential. In the electrophotographic photosensitive member 2, the outer diameter is larger at the middle portion 22A of the latent image area 22 than at the end portions 22B of the latent image forming area 22 in the axial direction. Therefore, the nip width between the electrophotographic photosensitive member 2 and the electrification mechanism 41, 41' is larger at the middle portion 22A of the latent image forming area 22 than at the end portions 22B of the latent image forming area 22.

Figure 9A:
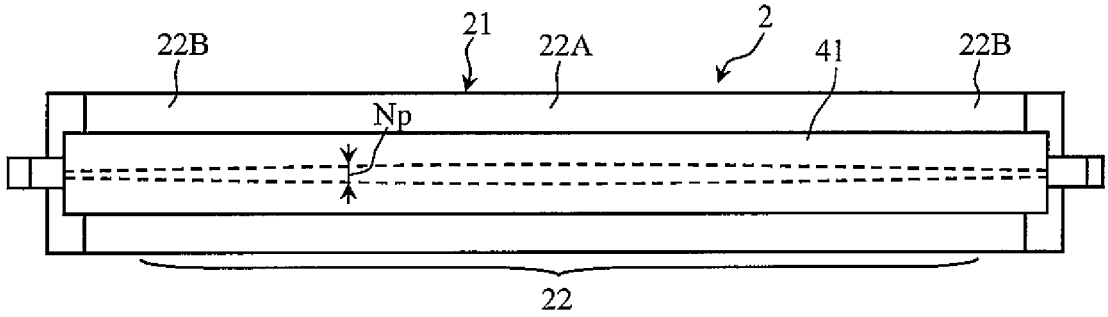
FIGS. 9A through 9C are plan views illustrating nip width between the electrophotographic photosensitive member and the electrification roller.
Figure 9B:
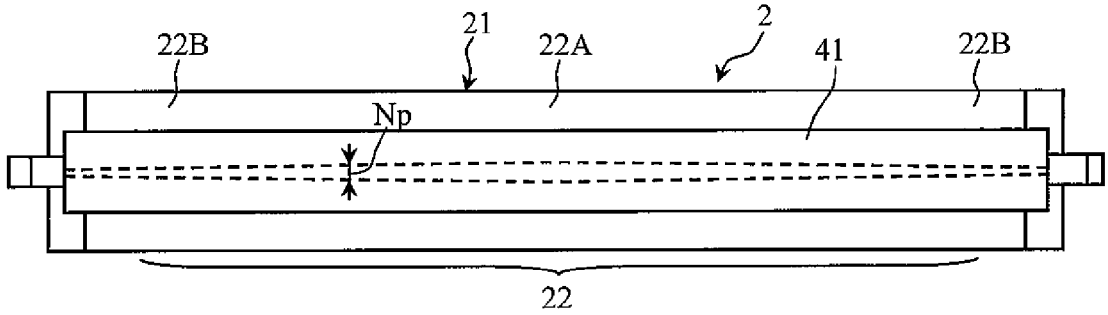
Figure 9C:
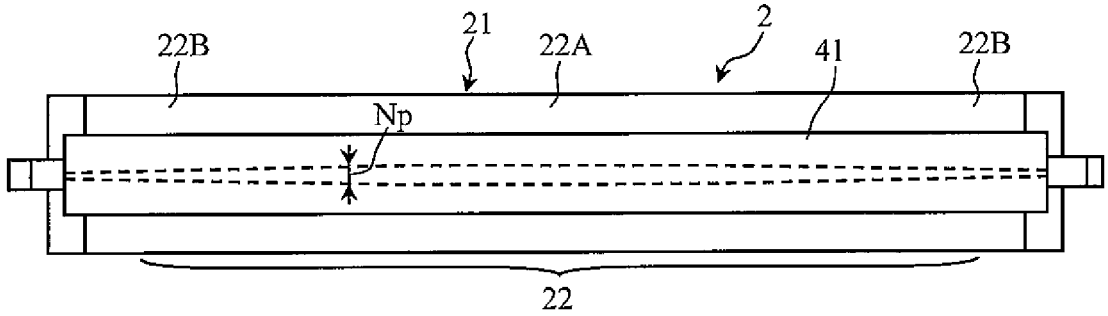

Specifically, when using the electrophotographic photosensitive member 2 shown in FIG. 3, as shown in FIG. 9A, a nip width Np gradually becomes larger with an inclination which gradually becomes smaller, as proceeding from the end portions 22B to the middle portion 22A of the latent image forming area 22. When using the electrophotographic photosensitive member 2 shown in FIG. 4A, as shown in FIG. 9B, a nip width Np gradually becomes larger with a constant inclination, as proceeding from the end portions 22B to the middle portion 22A of the latent image forming area 22. When using the electrophotographic photosensitive member 2 shown in FIG. 4B, as shown in FIG. 9C, a nip width Np becomes larger stepwise as proceeding from the end portions 22B to the middle portion 22A of the latent image forming area 22.

In the image forming apparatus 1 according to the present invention, the nip width Np at a reference point on the latent image forming area 22 may be adjusted according to temperature at the reference point. In such image forming apparatus 1, even if heat distribution is caused at the latent image forming area 22 of the photosensitive layer 21 due to heat of the heater, the nip width Np between the latent image forming area 22 and the electrification mechanism 41, 41' is adjusted according to the heat distribution, thereby preventing variation in electrification characteristic of the electrophotographic photosensitive member 2 due to the heat distribution.

The exposure mechanism 42 shown in FIG. 1 serves to form an electrostatic latent image on the electrophotographic photosensitive member 2, and is capable of emitting light of a predetermined wavelength (not less than 650 nm and not more than 780 nm, for example). The exposure mechanism 42 forms an electrostatic latent image which is an electric potential contrast by emitting light on the surface of the electrophotographic photosensitive member 2 according to an image signal, and lowering the electrical potential at the emitted portion. An example of the exposure mechanism 42 includes a LED head in which LED elements capable of emitting light at a wavelength of e.g. about 680 nm are arranged at 600 dpi.

Of course, the exposure mechanism 42 may be capable of emitting laser light. By replacing the exposure mechanism 42 having LED head with an optical system using e.g. laser light or a polygon mirror or with an optical system using e.g. a lens or a mirror through which light reflected at paper is transmitted, the image forming apparatus may have a function of a copying apparatus.

The development mechanism 43 forms a toner image by developing the electrostatic latent image formed on the electrophotographic photosensitive member 2. The development mechanism 43 includes a magnetic roller 43A for magnetically holding developer (toner), and a wheel (not shown) or a so-called skid for keeping a substantially constant distance (gap) from the electrophotographic photosensitive member 2.

The developer serves to develop a toner image formed on the surface of the electrophotographic photosensitive member 2, and is frictionally charged at the development mechanism 43. The developer may be a binary developer of magnetic carrier and insulating toner, or a one-component developer of magnetic toner.

The magnetic roller 43A serves to transfer the developer to the surface (developing area) of the electrophotographic photosensitive member 2.

In the development mechanism 43, the toner frictionally charged by the magnetic roller 43A is transferred in a form of magnetic brush with bristles each having a predetermined length. On the developing area of the electrophotographic photosensitive member 2, the toner is caused to stick to the surface of the photosensitive member by electrostatic attraction between the toner and the electrostatic latent image, and becomes visible. When the toner image is formed by regular developing, the toner image is charged in the reverse polarity of the polarity of the surface of the electrophotographic photosensitive member 2. On the other hand, when the toner image is formed by reverse developing, the toner image is charged in the same polarity as the polarity of the surface of the electrophotographic photosensitive member 2.

Though the development mechanism 43 utilizes dry developing method, wet developing method using liquid developer may be utilized.

The transfer mechanism 44 transfers the toner image of the electrophotographic photosensitive member 2 on a recording medium P supplied to a transfer area between the electrophotographic photosensitive member 2 and the transfer mechanism 44. The transfer mechanism 44 includes a transfer charger 44A and a separation charger 44B. In the transfer mechanism 44, the rear side (non-recording surface) of the recording medium P is charged in the reverse polarity of the toner image by the transfer charger 44A, and by the electrostatic attraction between this electrification charge and the toner image, the toner image is transferred on the recording medium P. Further, in the transfer mechanism 44, simultaneously with the transfer of the toner image, the rear side of the recording medium P is charged in alternating polarity by the separation charger 44B, so that the recording medium P is quickly separated from the surface of the electrophotographic photosensitive member 2.

As the transfer mechanism 44, a transfer roller driven with the rotation of the electrophotographic photosensitive member 2, and being spaced from the electrophotographic photosensitive member 2 by a minute gap (generally, not more than 0.5 mm) may be used. Such transfer roller applies a transfer voltage to the recording medium P, using e.g. direct-current power source, for attracting the toner image of the electrophotographic photosensitive member 2 onto the recording medium. In using the transfer roller, a separation member such as the separation charger 44B is omitted.

The fixing mechanism 45 serves to fix a toner image, which is transferred on the recording medium P, onto the recording medium P, and includes a pair of fixing rollers 45A, 45B. Each of the fixing rollers 45A, 45B is, for example, a metal roller coated by Teflon (registered trademark). In the fixing mechanism 45, the recording medium P passes through between the fixing rollers 45A, 45B, so that the toner image is fixed on the recording medium P by heat or pressure.

The cleaning mechanism 46 shown in FIGS. 1 and 2 serves to remove the toner remaining on the surface of the electrophotographic photosensitive member 2, and includes a cleaning blade 46A.

The cleaning blade 46A serves to scrape the remaining toner off the surface of the surface layer 29 of the electrophotographic photosensitive member 2. The cleaning blade 46A is supported by a case 46C via urging means such as springs 46B, so that its tip end presses the latent image forming area 22 of the electrophotographic photosensitive member 2. The cleaning blade 46A is made of a rubber material mainly containing polyurethane resin, for example, and has a thickness of not less than 1.0 mm and not more than 1.2 mm at its tip portion in contact with the surface layer 29 (see FIG. 2), a linear pressure of 14 gf/cm (generally not less than 5 gf/cm and not more than 30 gf/cm) and a JIS hardness of 74 degrees (preferably not less than 67 degrees and not more than 84 degrees).

The discharging mechanism 47 removes surface charge on the electrophotographic photosensitive member 2. The discharging mechanism 47 irradiates the whole surface (the surface layer 29) of the electrophotographic photosensitive member 2 by a light source such as LED, and removes the surface charge (remaining electrostatic latent image) of the electrophotographic photosensitive member 2.

Next, the function of the image forming apparatus 1 is described below.

In forming images by the image forming apparatus 1, the rotation mechanism 3 rotates the electrophotographic photosensitive member 2, while the heater 6 heats the electrophotographic photosensitive member 2 (photosensitive layer 21). Meanwhile, the surface of the electrophotographic photosensitive member 2 (photosensitive layer 21) is charged by the electrification mechanism 41, 41'.

Here, in the electrophotographic photosensitive member 2, the outer diameter at the middle portion 22A of the latent image forming area 22 is larger than at the end portions 22B of the latent image forming area 22 in the axial direction, and thus the nip width Np with the electrification mechanism 41, 41' is larger at the middle portion 22A of the latent image forming area 22 than at the end portions 22B of the latent image forming area 22. When heating the electrophotographic photosensitive member 2 (photosensitive layer 21) by the heater 6, the heat escapes from the power transmission flange 31 and the bearing flange 32 connected to the electrophotographic photosensitive member 2, while piling up at the middle portion 22A. Thus, temperature of the electrophotographic photosensitive member 2 is likely to be higher at the middle portion 22A of the latent image forming area 22 than at the end portions 22B of the latent image forming area 22. As the photosensitive layer 21 of the electrophotographic photosensitive member 2 has temperature dependency, the charging characteristic is lowered at a portion with high temperature. Therefore, the middle portion 22A of the electrophotographic photosensitive member 2 according to the present invention has high temperature and thus has low charging characteristic, while having relatively large nip width Np with the electrification mechanism 41, 41'. On the other hand, the end portions of the latent image forming area 22 have low temperature and thus have high charging characteristic, while having relatively small nip width Np with the electrification mechanism 41, 41'. As a result, in the electrophotographic photosensitive member 2, by changing the nip width Np with the electrification mechanism 41, 41' in the axial direction of the electrophotographic photosensitive member 2, variation in charging characteristic due to variation in temperature in the axial direction of the electrophotographic photosensitive member 2 can be prevented.

In the electrophotographic photosensitive member 2, the outer diameter of the cylindrical body 20 becomes larger gradually or stepwise as proceeding from the end portions 22B to the middle portion 22A of the latent image forming area 22. Thus, the charging characteristic of the electrophotographic photosensitive member 2 can be gradually changed in the axial direction (corresponding to heat distribution due to heat from the heater 6). Therefore, in the electrophotographic photosensitive member 2, variation in charging characteristic in the axial direction can be properly prevented.

As described above, the exposure mechanism 42 exposes the electrophotographic photosensitive member 2 to form electrostatic latent image on the electrophotographic photosensitive member 2 as an electric potential contrast. The electrostatic latent image is developed by the development mechanism 43. Specifically, toner is caused to stick to the surface of the electrophotographic photosensitive member 2 by electrostatic attraction between the toner and the electrostatic latent image which is caused to be visible.

More specifically, the rear side of a recording medium P such as paper is charged in the reverse polarity of the toner image by the transfer charger 44, whereby the toner image on the surface of the electrophotographic photosensitive member 2 is transferred on the recording medium P. The toner image transferred on the recording medium P is fixed on the recording medium P by heat or pressure by the fixing mechanism 45.

In the image forming apparatus 1, the toner remaining on the surface of the electrophotographic photosensitive member 2 is mechanically removed by the cleaning mechanism 46, and remaining electrostatic latent image is removed by emitting intense light onto the entire surface of the electrophotographic photosensitive member 2 by the discharging mechanism 47.

As described above, in the image forming apparatus, variation in charging characteristic in the axial direction of the electrophotographic photosensitive member 2 is prevented.

Thus, on the electrophotographic photosensitive member 2, electrostatic latent images can be properly formed, and thus toner images can be properly formed. As a result, the toner images transferred and fixed on the recording medium P are prevented from variation in image density.

In this way, in the image forming apparatus 1, variation in charging characteristic in the axial direction of the electrophotographic photosensitive member 2 can be prevented and thus variation in image density can be prevented. Such effect can also be properly obtained when the photosensitive layer of the electrophotographic photosensitive member 2 includes a photoconductive layer 28 made of an inorganic material, and a surface layer 29 made of an inorganic material and laminated on the photoconductive layer 28.

The present invention is not limited to the above-described embodiments, but may be variously modified. For example, the nip width between the electrophotographic photosensitive member and the electrification mechanism may be set by modifying the structure of the electrification mechanism, so that the nip width is larger at the middle portion than at the end portions of the latent image forming area. Specifically, the nip width can be changed, for example, by setting the outer diameter of the electrification roller to be larger at the middle portion than at the end portions in the axial direction, or positioning the electrification mechanism to be inclined relative to the axial direction.

Further, the heating means for heating the electrophotographic photosensitive member is not limited to the heater accommodated within the electrophotographic photosensitive member. Alternatively, a heating means provided outside of the electrophotographic photosensitive member, or heat generated from a component incorporated in the image forming apparatus other than the electrophotographic photosensitive member may be used.

EXAMPLE

In the present example, it was studied how changes in outer diameter of the cylindrical body of the electrophotographic photosensitive member affects variation in image when using a contact electrification roller.

(Manufacture of Electrophotographic Photosensitive Member)

The cylindrical body was made of a 5052-O aluminum alloy drawn tube with outer diameter of ϕ30.3 mm, inner diameter of ϕ25 mm, and length of 340 mm. Specifically, in manufacture of the cylindrical body, a lathe (RL600 manufactured by Eguro Ltd.) was used for roughly cutting the end surfaces, the inner surface, and the outer surface of the drawn tube, and as a finish process, using a NC lathe (RL600 manufactured by Eguro Ltd.), mirror grinding was performed to the outer surface of the drawn tube by a diamond cutting tool. In the finish process, numerical control was performed to change the outer diameter in the axial direction of the cylindrical body, so that a plurality of cylindrical bodies having different outer diameters was manufactured.

The cylindrical body made in this way was cleaned utilizing ultrasonic and then incorporated in the reactor of the CVD apparatus shown in FIG. 7, and a photosensitive layer was formed with a thickness of 31 μm under film forming conditions shown in the following Table 1.

In the CVD apparatus shown in FIG. 7, for forming the photosensitive layer to have a constant thickness in the axial direction, the length of the positioning rings 50A, 50B was adjusted to position the cylindrical body 20 within a stabilized discharge area. In order to form the photosensitive layer to have a constant thickness also in the circumferential direction, the cylindrical body 1 was rotated together with the body holder 51 by the motor 52 at a rotation velocity of 1 rpm.

TABLE 1

Conditions for Forming Photosensitive Layer (amount of each gas is the absolute amount to be introduced in CVD apparatus)

| | |
|---|---|
| **Anti-charge Injection Layer** | |
| Temperature of Body [° C.] | 260 |
| Gas Pressure [Pa] | 60 |
| 13.56 Hz RF Electric Power [W] | 120 |
| Film Forming Time [min] | 80 |
| $SiH_4$ Gas Flow Amount [sccm] | 75 |
| $B_2H_6$ Gas Flow Amount [sccm] | 0.1 |
| NO Gas Flow Amount [sccm] | 10 |
| Film Thickness [μm] | 4 |
| **Photoconductive Layer** | |
| Temperature of Body [° C.] | 260 |
| Gas Pressure [Pa] | 75 |
| 13.56 Hz RF Electric Power [W] | 125 |
| Film Forming Time [min] | 380 |
| $SiH_4$ Gas Flow Amount [sccm] | 100 |
| $B_2H_6$ Gas Flow Amount [sccm] | 0.0002 |
| $H_2$ Gas Flow Amount [sccm] | 125 |
| Film Thickness [μm] | 26 |
| **Surface Layer** | |
| Temperature of Body [° C.] | 260 |
| Gas Pressure [Pa] | 70 |
| 13.56 Hz RF Electric Power [W] | 155 |
| Film Forming Time [min] | 80 |
| $SiH_4$ Gas Flow Amount [sccm] | 40 |
| $CH_4$ Gas Flow Amount [sccm] | 230 |
| He Gas Flow Amount [sccm] | 295 |
| Film Thickness [μm] | 1 |

Next, a heater was accommodated within the cylindrical body. The heater included a pair of insulating sheets sandwiching a resistor therebetween. One of the insulating sheets contacting the inner surface of the cylindrical body was a PET film with a thickness of 1 mm, while the other insulating sheet was a PET film with a thickness of 3 mm. The resistor was made of a nichrome wire with a diameter of 0.8 mm, by covering silicon rubber thereon and arranging in a wavy line. Note that the resistor was formed uniformly, differently from the heater 6 as shown in FIGS. 5 and 6, in which the resistor is formed in an arrangement thinner at the middle portion than at the end portions.

(Measurement of Outer Diameter of Cylindrical Body)

The outer diameter of the cylindrical body was measured at any 10 points in the circumferential direction of the cylindrical body, and the measurement values at the ten points were averaged. For measurement, a non-contact laser outer-diameter measurer (DV-305.LSM506/6000 manufactured by Mitutoyo Corporation) was used. Measurements were performed at the middle portion of the latent image forming area spaced from one end surface of the body by 160 mm in the axial direction, at one of the end portions of the latent image forming area spaced from one end surface of the body by 40 mm in the axial direction (end portion diameter 1), and at the other of the end portions of the latent image forming area spaced from the end surface of the body by 320 mm in the axial direction (end portion diameter 2). Measurement results of the outer diameters are shown in the following Table 2.

(Evaluation of Variation in Image)

The electrophotographic photosensitive member was incorporated in an image forming apparatus (KM-8030$_{(remodeled)}$ manufactured by Kyocera Mita Corporation). Under conditions repeatedly changed from room temperature of 5° C. and humidity of 15% RH to room temperature of 40° C. and humidity of 85% RH, variation in image density of halftone image was visually checked for evaluation. Temperature of the electrophotographic photosensitive member was controlled by the heater to be about 35° C.

The contact electrification roller was made of a round stainless steel based material, and is provided with a resistor layer having volume resistivity value of $2\times10^9$ Ω·cm. The resistor layer was made of a carbon black dispersed and mixed in silicon rubber and its hardness (Asker C hardness) is 50 degree. The electrification roller was brought into contact with the electrophotographic photosensitive member under pressing power of not less than 7N and not more than 10N. The image forming apparatus worked under process conditions as described below.

Process Conditions of Image Forming Apparatus (at the Middle Portion of the Latent Image Forming Area)

Circumferential Velocity of Photosensitive Member: 130 mm/sec

Charging Voltage: 280V

Surface Temperature of Photosensitive Member: 35° C.

Type of Electrification Mechanism: Electrification Roller (Contact Type)

Nip Width: 2 mm

Type of Exposure Mechanism: Laser Unit

Wavelength: 680 nm

Light Exposure: 0.3 μJ/cm$^2$

Type of Discharging Mechanism: LED Unit

Wavelength: 660 nm

Light Exposure: 5.5 μJ/cm$^2$

The evaluation results of images were placed in four grades A, B, C, and D. A, B, and C are the image qualities without no practical problem. The evaluation results are shown in the following Table 2 together with the measurement results of the outer diameters of the cylindrical bodies. Table 2 also shows the measurement results of the nip width of each sample.

TABLE 2

| | Outer Diameter of Body (mm) [Nip Width (mm)] | | | |
|---|---|---|---|---|
| | Middle Portion of | End Portions of Latent Image Forming Area | | Image |
| Sample No. | Latent Image Forming Area | End Portion Diameter 1 | End Portion Diameter 2 | Evaluation Results |
| 1 | Φ 30.020 [2.0] | Φ 30.021 [2.0] | Φ 30.020 [2.0] | D |
| 2 | Φ 30.021 [2.0] | Φ 30.016 [1.8] | Φ 30.015 [1.9] | A |
| 3 | Φ 30.020 [2.1] | Φ 29.999 [1.5] | Φ 30.000 [1.6] | A |
| 4 | Φ 30.020 [2.0] | Φ 29.990 [1.0] | Φ 29.985 [1.2] | B |

As can be seen from Table 2, the sample No. 1 is a conventional electrophotographic photosensitive member out of the scope of the present invention. As the nip width was constant, variation in image density was generated corresponding to change of use environment.

On the other hand, in the samples No. 2 to 4 according to the present invention, no variation in image density was generated. Especially in the samples No. 2 and 3, good evaluation results were obtained.

The invention claimed is:

1. An image forming apparatus comprising:

an electrophotographic photosensitive member including a substantially cylindrical body having outer circumference on which a photosensitive layer with a latent image forming area is formed; and a contact electrification unit positioned substantially parallel to axial direction of the body;

wherein a nip width of a contact area between the photosensitive layer and the electrification unit is larger at a middle portion than at end portions of the latent image forming area, wherein the nip width gradually becomes larger as proceeding from the end portions to the middle portion of the latent image forming area, wherein the outer diameter of the body gradually becomes larger as proceeding from the end portions to the middle portion of the latent image forming area.

2. The image forming apparatus according to claim 1, wherein the nip width becomes larger stepwise as proceeding from the end portions to the middle portion of the latent image forming area.

3. The image forming apparatus according to claim 1, further comprising a heating member for heating the latent image forming area of the photosensitive layer.

4. The image forming apparatus according to claim 1, wherein during operation, temperature of the latent image forming area is higher at the middle portion than at the end portions of the latent image forming area.

5. The image forming apparatus according to claim 1, wherein the photosensitive layer comprises a photoconductive layer made of inorganic material and a surface layer made of inorganic material and laminated on the photoconductive layer.

6. The An image forming apparatus comprising:

an electrophotographic photosensitive member including a substantially cylindrical body having outer circumference on which a photosensitive layer with a latent image forming area is formed; and a contact electrification unit positioned substantially parallel to axial direction of the body;

wherein a nip width of a contact area between the photosensitive layer and the electrification unit is larger at a middle portion than at end portions of the latent image forming area, wherein the nip width becomes larger stepwise as proceeding from the end portions to the middle portion of the latent image forming area, wherein the outer diameter of the body becomes larger stepwise as proceeding from the end portions to the middle portion of the latent image forming area.

* * * * *